United States Patent [19]

Salem

[11] 4,194,191

[45] Mar. 18, 1980

[54] SMOKE SIMULATING TEST APPARATUS FOR SMOKE DETECTORS

[75] Inventor: Robert J. Salem, Danbury, Conn.

[73] Assignee: General Electric Company, New York, N.Y.

[21] Appl. No.: 874,363

[22] Filed: Feb. 1, 1978

Related U.S. Application Data

[63] Continuation of Ser. No. 630,204, Nov. 10, 1975, abandoned.

[51] Int. Cl.[2] ..... G08B 29/00; G08B 17/10

[52] U.S. Cl. ..... 340/515; 313/54; 250/381; 340/629

[58] Field of Search ..... 340/629, 514, 515, 516; 250/381; 313/54

[56] References Cited

U.S. PATENT DOCUMENTS 4,081,684 3/1978 Wieder ..... 250/381

*Primary Examiner*—John W. Caldwell, Sr.
*Assistant Examiner*—Daniel Myer
*Attorney, Agent, or Firm*—George R. Powers; Carlos Nieves; Leonard J. Platt

[57] ABSTRACT

A smoke detector of the ionization type is provided with a movable test target or probe for intercepting alpha radiation within the measuring chamber when moved to a particular position. As a result of the interception of alpha particles, the electrical resistance of the chamber between a pair of electrodes is increased. Since the electrical resistance similarly increases when airborne products of combustion enter the measuring chamber, the operative position and size of the test target may be selected such that its movement to its operative position results in electrical simulation of a predetermined level of airborne products of combustion within the measuring chamber.

7 Claims, 6 Drawing Figures

SMOKE SIMULATING TEST APPARATUS FOR SMOKE DETECTORS

This is a continuation of application Ser. No. 630,204, filed Nov. 10, 1975, now abandoned.

BACKGROUND OF THE INVENTION

1. Field of the Invention

This invention relates to smoke detectors of the ionization type and, more particularly, to test apparatus for simulating the presence of a predetermined level of airborne products of combustion within a measuring chamber.

2. Description of the Prior Art

A smoke detector of the ionization type includes an alpha radiation source, such as a small quantity of Americium 241, in a measuring chamber having positive and negative electrodes. The measuring chamber is substantially freely accessible to the atmosphere, including airborne products of combustion. The alpha radiation in the measuring chamber ionizes the air between the electrodes, the result being the flow of a small electrical current when voltage is applied across the electrodes. When airborne products of combustion (smoke) enter the measuring chamber, they reduce the mobility of the ions and thereby increase the resistance of the measuring chamber to the flow of current. The resulting change in the electrical characteristics of the circuit containing the measuring chamber is sensed and used to trigger an alarm when the electrical change reaches a selected level representing a corresponding level of smoke or aerosols within the measuring chamber. The electrical characteristic normally sensed is the change in the voltage across the measuring chamber, the voltage change occurring as a result of the increased chamber resistance due to the presence of visible or invisible products of combustion in the measuring chamber. The sensing or alarm apparatus senses this change in voltage and triggers the alarm when the voltage change reaches the selected level.

It is essential that the smoke detector be highly sensitive and reliable in operation. It is therefore desirable that it be periodically tested to make certain that all of its operative components including the measuring chamber and the alarm apparatus are operating properly. In the past, a common way to test an ionization smoke detector has been to intentionally introduce smoke into the measuring chamber, as by blowing cigarette smoke at the detector, and to assume that everything is working properly in the event that this produces an alarm signal. This approach may not be altogether satisfactory in that there is no way to determine precisely how much smoke actually enters the chamber. For example, for adequate early warning of fires without undue false alarming in response to normal cooking fumes and the like, it is desirable that the alarm be sounded when the smoke level within the measuring chamber is in the range of 2 percent (2 parts per 100). If smoke is blown at the detector, the person testing the system does not know if the alarm has sounded in response to 2 percent smoke or 10 percent or more smoke in the measuring chamber. In other words, an ionization smoke detector may not be operating properly and still pass the "smoke" test. Another test approach has been to provide a test button which, when depressed, introduces into the alarm circuitry an electrical simulation of the measuring chamber characteristics when a predetermined level of combustion product or smoke is present within the chamber. For example, depression of the button in such a system may shunt the measuring chamber with a resistor having a resistance equal to the chamber resistance when the predetermined level of smoke is present within the chamber. It will be readily appreciated by those skilled in the art that this approach adequately tests the performance of the alarm system, but not the operation of the measuring chamber. It is extremely desirable that test means be provided for testing the entire system and all operative components including the measuring chamber and the alarm apparatus.

SUMMARY OF THE INVENTION

It is a primary object of the present invention to provide improved means for testing a smoke detector of the ionization type for proper operation.

Another object of this invention is to provide for ionization smoke detectors improved means for testing the entire system including the measuring chamber and the alarm apparatus.

Yet another object is to provide improved testing means for determining whether or not an ionization type smoke detector is operating properly when a predetermined minimum level of smoke or combustion product is present within the measuring chamber.

Briefly state, in carrying out the invention in one form, a smoke detector of the ionization type is provided with a measuring chamber and intercepting means movable within the measuring chamber between a first position and a second position in which it intercepts alpha particles and thereby increases the electrical resistance of the chamber so as to simulate the presence within the chamber of a predetermined level of airborne products of combustion. More particularly, the measuring chamber has an interior substantially freely accessible to airborne products of combustion. First and second spaced apart electrodes are provided within the measuring chamber, and a source of alpha radiation is provided for ionizing the air between the electrodes such that current flows between the electrodes when appropriate voltage is applied across the electrodes. Alarm means is coupled to the measuring chamber for producing an alarm signal when the electrical resistance of the measuring chamber is consistent with the presence within the measuring chamber of a predetermined level of airborne products of combustion. The intercepting means is movable between a first neutral position and a second position closer to the source of alpha radiation for intercepting alpha particles. Manually operable means is coupled to the intercepting means for moving the intercepting means between the first and second positions to increase the electrical resistance between the electrodes. The size of the intercepting means and the location of its second position are selected such that the electrical resistance between the electrodes when the intercepting means is in its second position is substantially identical to the electrical resistance when the intercepting means is in its first position and the predetermined level of products of combustion is present within the measuring chamber. In this manner, movement of the intercepting means to its second position simulates the presence within the chamber of predetermined level of products of combustion and provides testing of the entire detection system including the measuring chamber and the alarm means.

By a further aspect of the invention, the intercepting means is electrically insulated from each of the electrodes at least when it is in its second position. By a still further aspect of the invention, the intercepting means is electrically coupled to a selected one of the electrodes when it is in its first position. By still further aspects of the invention, the intercepting means includes an electrically conductive target contacting the selected electrode when the intercepting means is in its first position, and the manually operated means for moving the intercepting means includes a button mounted externally of the measuring chamber, insulating shaft means interconnecting the conductive target and the button, and bising means urging the intercepting means toward its first position.

BRIEF DESCRIPTION OF THE DRAWINGS

While the novel features of this invention are set forth with particularity in the appended claims, the invention, both as to organization and content, will be better understood and appreciated, along with other objects and features thereof, from the following detailed description taken in conjunction with the drawings in which:

DETAILED DESCRIPTION

Figure 1:
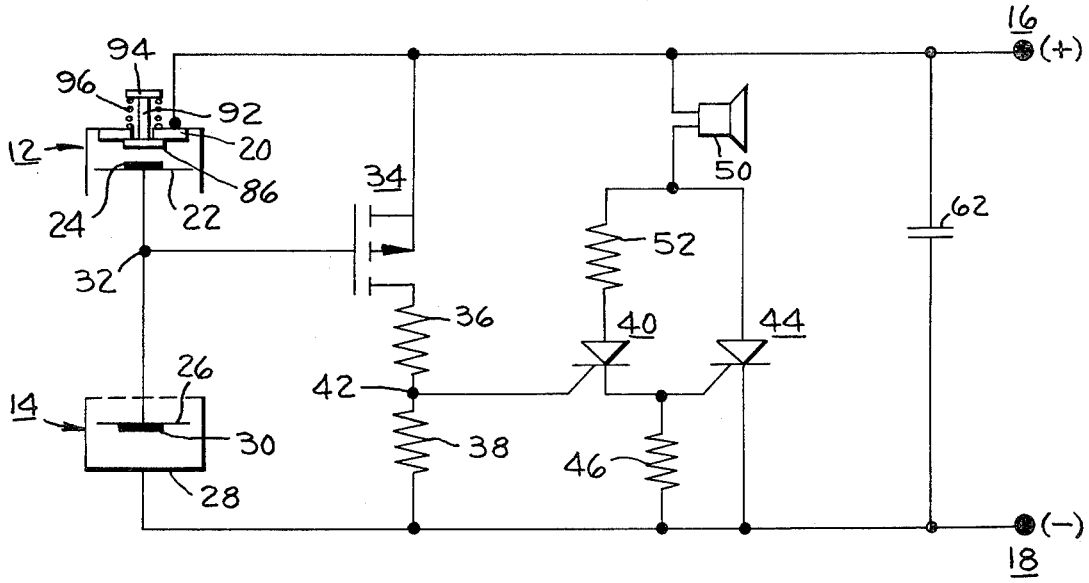
FIG. 1 is a circuit diagram of a smoke detector incorporating the test apparatus of this invention.

Referring first to FIG. 1, a smoke detector 10 incorporating the test apparatus of the present invention is illustrated. The smoke detector 10 includes a pair of ionization chambers 12 and 14 connected in series across a pair of terminals 16 and 18 to which a suitable source of direct current power may be connected. The particular circuit illustrated is designed to be connected to a direct current battery having a voltage in the 10.5 to 12.5 volt range, the positive and negative terminals of the battery being connected to the terminals 16 and 18, respectively, as indicated. The chamber 12 is open to the atmosphere and its interior is thus freely accessible to air and airborne products of combustion or aerosols. The chamber 14 is substantially closed and its interior is thus not freely accessible to airborne products of combustion. For reasons which will become apparent as this description proceeds, the chamber 12 is a measuring chamber and the chamber 14 is a reference chamber.

Figure 2:
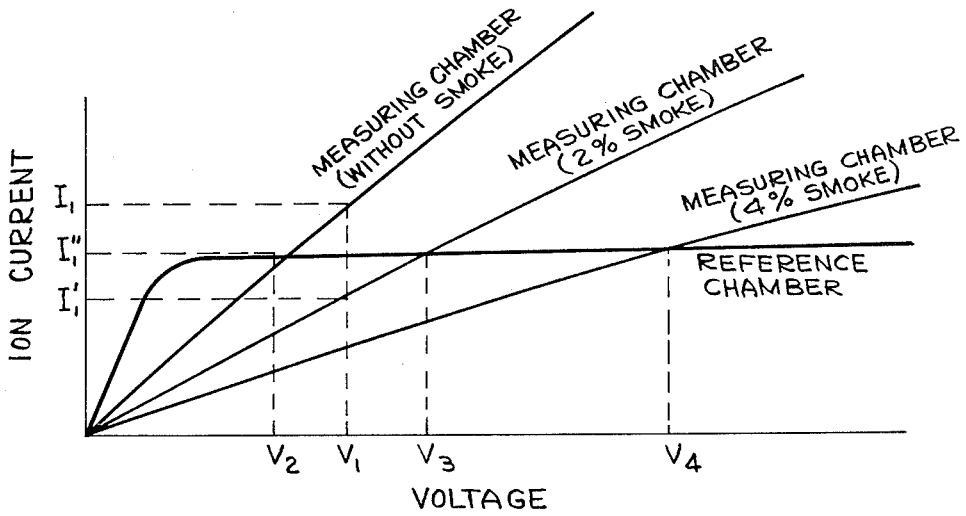
FIG. 2 is a graph illustrating the change in voltage across the measuring chamber of FIG. 1 upon either the introduction of combustion products or operation of the test apparatus of this invention.

As illustrated, the measuring chamber 12 includes a pair of spaced apart electrodes 20 and 22 and a source 24 of alpha radiation such as Americium 241 for ionizing the air in the interior space between the electrodes 20 and 22. As previously explained, an ion current will flow between the electrodes 20 and 22 when a voltage is applied thereacross. If aerosols or products of combustion enter the interior space of the chamber 12, the current flow will be reduced if the voltage across the elctrodes is maintained constant. In other words, the introduction of combustion aerosols increases the electrical resistance of the chamber 12, the amount of resistance change being indicative of the amount of combustion products present in the chamber 12. For example, if a constant voltage $V_1$ as shown by FIG. 2 is applied across the measuring chamber 12, an ion current $I_1$ will flow when there is no smoke present in the chamber, and an ion current $I_1'$ will flow when there is 2 percent smoke present in the chamber. The reference chamber 14 includes a pair of spaced apart electrodes 26 and 28 and a source 30 of alpha radiation such as Americium 241 for ionizing oxygen and nitrogen molecules in the interior space between the electrodes 26 and 28. Since products of combustion are effectively barred from entering the interior of the chamber 14, there is substantially only one possible ion current for each voltage applied across the terminals 26 and 28 (under constant ambient atmospheric conditions). With reference to FIG. 2, it will be seen that the ion current through the reference chamber 14 will be $I_1''$ if $V_1$ is applied across the terminals 26 and 28 at the assumed ambient conditions.

Ionization chambers such as the chambers 12 and 14 have characteristic curves of the type illustrated by FIG. 2. The curve for each chamber has an initial generally linear slope in which there is a substantially direct relationship between applied voltage and ion current. When, however, the voltage exceeds a certain level, the chamber becomes saturated and will exhibit substantially constant current through a broad range of applied voltages. The actual configuration of the characteristic curve for a chamber depends on factors such as the voltage gradient within the chamber, the strength of the alpha radiation source, and the other physical characteristics of the chamber. The basic characteristics of the chambers 12 and 14 are illustrated by the curves of FIG. 2, the measuring chamber 12 being in its essentially linear condition throughout the indicated voltage range and the reference chamber reaching saturation at relatively low voltages. It is desirable in the circuit arrangement of FIG. 1 that the measuring chamber 12 operate in its linear region and that the reference chamber 14 operate in its saturated region.

Figure 3:
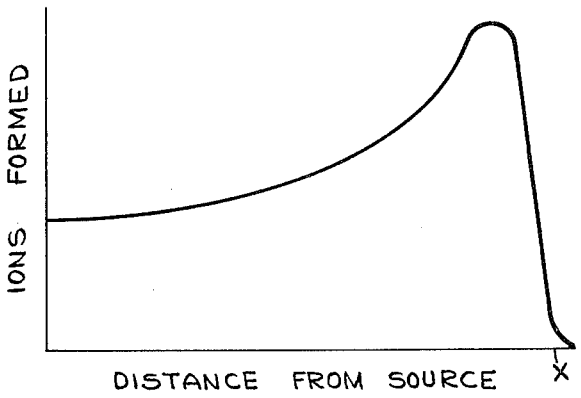
FIG. 3 is a Bragg diagram illustrating the number of ions formed as a function of the distance through which alpha particles travel from the source of radiation.
Figure 4:
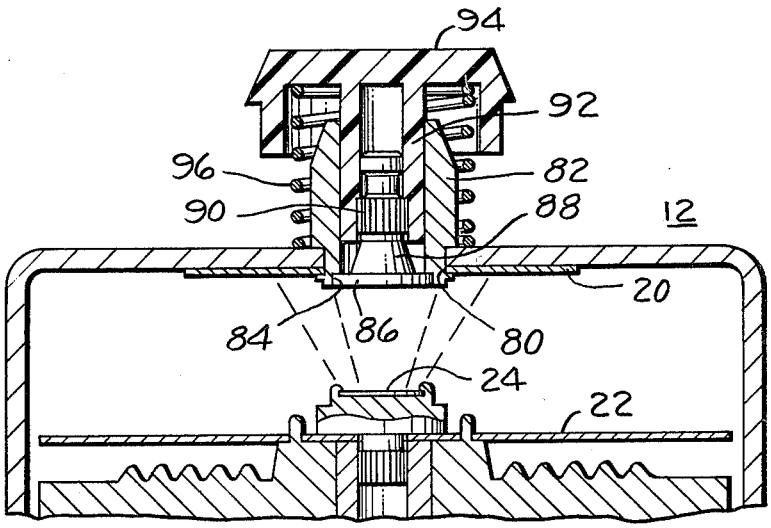
FIG. 4 is a detailed view of the measuring chamber and one form of the intercepting means of this invention and the means for moving the intercepting means.

As illustrated by FIG. 4, the source 24 of alpha radiation ionizes the air within the measuring chamber 12 within a field of radiation as indicated by the dashed lines. It is well known that the number of ions formed and the magnitude of the ion current in response to a voltage applied across the electrodes 20 and 22 are related to the distance that the alpha particles travel from the source, the relationship being shown diagrammatically by the Bragg diagram of FIG. 3. As shown, the number of ions formed increases with increasing distance until distance X, which is approximately three centimeters, is reached, after which substantially all of the energy of the alpha particles is exhausted and the formation of additional ion ceases. In the measuring chamber 12 of FIGS. 1 and 4, the distance between the source 24 and the electrode 20 is less than three centimeters. As a result, the maximum number of ions is produced when the alpha particles leaving the source 24 travel unhindered across the interior of the chamber. If a fixed voltage is applied across the electrodes 20 and 22, the ion current will be at its maximum level under these conditions. Stated differently, it can be said that the electrical resistance of the chamber is relatively low under these conditions. If, however, airborne products of combustion enter the chamber, collisions will occur between some of the alpha particles and the relatively heavy smoke particles, the alpha particles losing their energy in the collision and thereafter being unable to create additional ions. In addition, some ions will attach themselves to smoke particles. The result of these occurrences is a reduction in the number of ions formed, a reduction in the ion current for the fixed voltage across the electrodes, and an increase in the electrical resistance of the chamber. It will be obvious that the resistance of the chamber will increase with increasing quantities of smoke since higher levels of smoke in the chamber will result in the interception of more alpha particles.

Figure 5:
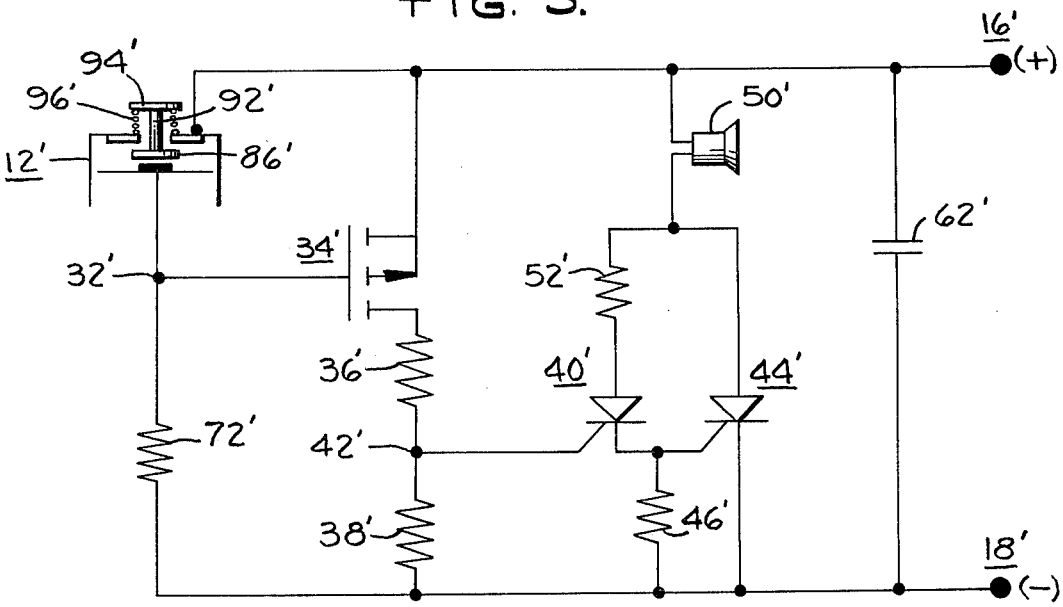
FIG. 5 is a circuit diagram similar to FIG. 1 illustrating the incorporation of the test apparatus of this invention in a smoke detector having a single ionization chamber.

Referring now to FIGS. 1 and 2, the chambers 12 and 14 are connected in series across the terminals 16 and 18 such that the substantially fixed voltage $V_B$ of a battery connected to the terminals is applied across the circuit comprising the two chambers. Since the reference chamber 14 is intentionally designed to operate in its saturated range, it is clear that a substantially constant ion current $I_1''$ flows through the chamber 14 at all times. Since the chambers 12 and 14 are connected in series, the same ion current $I_1''$ will flow at all times through the measuring chamber 12. In the absence of smoke, the voltage drop across the chamber 12 will be $V_2$. Similarly, the voltage drop across the chamber 12 will be $V_3$ when 2 percent smoke is present between its electrodes, and the voltage across the chamber 12 will be $V_4$ when 4 percent smoke is present. It will, of course, be obvious that the voltage across the reference chamber 14 is $V_B$–$V_2$ when no smoke is present, $V_B$–$V_3$ at 2 percent smoke and $V_B$–$V_4$ at 4 percent smoke. It thus will be seen that the voltage at junction 32 intermdiate the chambers 12 and 14 is indicative of the level of airborne products of combustion within the chamber 12. Alarm generating circuit means are coupled to the measuring chamber 12 and the junction 32 to sense the change in voltage at the junction 32 and producing an alarm signal when the voltage is consistent with the presence of a predetermined minimum amount of smoke or the like within the chamber 12. FIGS. 1 and 5 disclose various forms of circuitry suitable for this purpose.

As illustrated by FIG. 1, the alarm generating means includes a MOSFET field effect transistor 34 of the enhancement type having its gate coupled to the junction 32. The source of the MOSFET 34 is connected to the positive terminal 16, and the drain of the MOSFET is connected through series resistors 36 and 38 to the negative terminal 18. High gain switching means comprising a pair of cascaded SCR's are coupled to the MOSFET 34 by having the gate of the first SCR 40 connected to the junction 42 between the two series resistors 36 and 38. The cathode of the first SCR 40 is connected both to the gate of the second SCR 44 and through a resistor 46 to the negative terminal 18. The second SCR is connected in series with a horn assembly 50 across the terminals 16 and 18. A resistor 52 is provided between the anode of the first SCR 40 and the horn assembly 50. A capacitor 62 is provided across the terminals 16 and 18 to prevent rapid changes in supply voltage during sounding of the horn 50.

When there is no smoke or other airborne products of combustion within the measuring chamber 12, the voltage across the measuring chamber 12 is less than the threshold voltage of the MOSFET 34. Since the MOSFET 34 is of the enhancement type, this means that the MOSFET is OFF (not conducting) under these conditions. Since the MOSFET 34 is OFF, there is no current flow through the resistors 36 and 38 and the junction 42 is maintained at the voltage of the negative terminal 18. As a result, the first SCR 40 is also maintained in its OFF or non-conductive condition. Since the first SCR 40 is not conducting, the gate of the second SCR 44 is also maintained at the voltage of the negative terminal 18. This means that the SCR 44 remains non-conductive and the horn 50 is not sounded. It should be noted that all elements of the sensing and switching means are turned OFF under these conditions and thus will place no continuous current drain on a battery connected across the terminals 16 and 18.

If smoke or other combustion products enter the chamber 12, the voltage across the chamber 12 and the source-to-gate of the MOSFET 34 increase. If the elements are selected and adjusted such that the threshold voltage of the MOSFET 34 is reached when 2 percent smoke is present in the measuring chamber 12, the MOSFET will conduct when the voltage at junction 32 is consistent with the presence of at least 2 percent smoke in the chamber 12. In other words, the MOSFET 34 will conduct whenever the smoke concentration within the chamber is 2 percent or greater. Through proper selection and adjustment of the components, the MOSFET 34 can be made to initially conduct at any desired minimum amount of smoke concentration. Once the MOSFET 34 begins to conduct, current will flow through the resistors 36 and 38, increasing the voltage at junction 42 sufficiently to turn on the first SCR 40. Due to the current flow through the SCR 40 and the resistor 46, the voltage on the gate of the SCR 44 will be sufficient to turn on the SCR 44 and thus sound the horn 50. If the smoke level in chamber 12 drops below the preselected trigger point, the voltage at the junction 32 will rise, and the voltage on the MOSFET 34 will therefore fall below the threshold level and the MOSFET 34 will turn OFF. This means that the voltage at junction 42 will also fall and the SCR 40 will turn OFF when its current falls below its holding level (due to periodic opening during horn operation of the normally closed horn contacts). This in turn will cause the second SCR 44 to turn OFF both itself and the horn 50.

In FIG. 5, a single ionization chamber 12' is provided in series with a resistor 72 across terminals 16' and 18' for connection to an appropriate source of direct current power. If products of combustion enter the measuring chamber 12', its resistance will increase, the result being both a reduction in the ion current flow through the circuit and an increase in the voltage across both the chamber 12 and the source-to-gate of a MOSFET 34'. At a predetermined minimum level of smoke in the chamber 12', the voltage at the junction 32' will drop sufficiently to turn ON the enhancement mode MOSFET 34'. Conduction through the MOSFET 34' will turn on the horn 50' in the same manner as in the circuit of FIG. 1. For a more detailed description of the smoke detection and alarm apparatus just described with respect to FIGS. 1 and 5, attention is directed to co-pending patent application Ser. No. 630,202, now abandoned, filed herewith in the name of Robert J. Salem for HIGH GAIN SENSING AND SWITCHING MEANS FOR SMOKE DETECTORS and assigned to the assignee of this invention.

The test apparatus of this invention will now be described with reference to FIGS. 4 and 6. As illustrated, the electrode 20 has a central opening 80 which receives the lower end of a metal conductive generally cylindrical bushing 82, which has a counterboard recess 84 for receiving a flat conductive target plate 86. The target plate 86 along with a conductive stud 88 secured to its back form the intercepting means of the present invention. The stud 88 includes a knurled portion 90 which is force fitted into a depending shaft portion 92 of a button 94 located externally of the chamber 12. The shaft 92 is slidably received in the upper portion of the bushing 82, and a compression spring 96 surrounds the bushing 82 to bias the button 94 upwardly until the target plate 86 seats in the counterbored recess 84. This position as illustrated by FIG. 4 will hereinafter be referred to as the first position of the intercepting means. When it is desired to test the smoke detector, pressure is exerted on the button 94 to overcome the biasing spring 96 and move the intercepting means to a second position shown by FIG. 6. For reasons which will become apparent as this description proceeds, the shaft 92 is formed of an insulating material such as plastic, and it stops short of the target plate 86 by a distance sufficient to prevent entry of the plastic into the chamber 12 when the intercepting means is moved to its second position.

When the intercepting means is located as shown by FIG. 4, the target plate 86 and the bushing 82 form with the electrode 20 an electrically continuous electrode surface across the top of the chamber 12. It may thus be said that the intercepting means does not extend into the field of radiation. When, however, the intercepting means is moved to its second position as illustrated by FIG. 6, the target plate 81 and the stud 88 extend into the field of radiation and intercept some of the alpha particles before they complete their journey across the chamber. As a result, the amount of ionization in the chamber is reduced, and the chamber resistance increases just as it would if smoke had entered the chamber. By making the shaft 92 of insulating material, electrical conduction is prevented between the target plate 86 and the electrode 20 so as to avoid any significant change in the electric field within the chamber as the intercepting means is moved out of its first position and toward its second position. In addition, by making the target plate conductive and having its contact the electrode 20 through the bushing 82 when the intercepting means is in its first position, any static electricity present when the button 94 is depressed will be immediately dissipated through the electrode 20.

Figure 6:
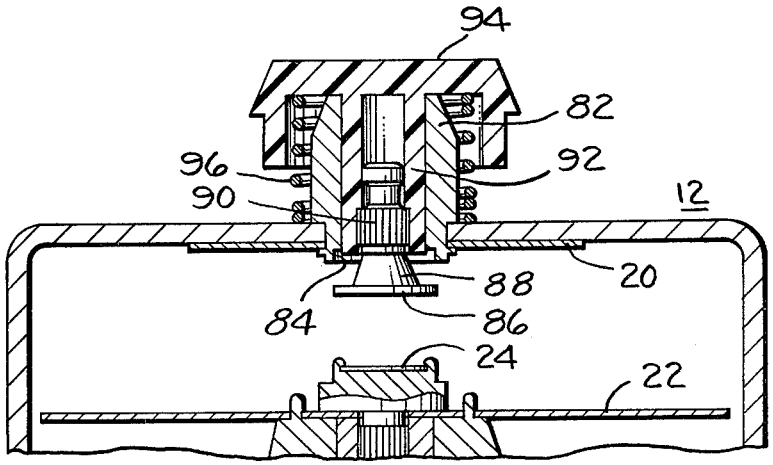
FIG. 6 is a view similar to FIG. 4 showing the intercepting means in its second position.

Referring now to FIGS. 1, 4 and 6, if it is desired that the alarm 50 sound when a predetermined minimum level of smoke, say 2 percent, is present within the measuring chamber 12, the MOSFET 34 and other alarm circuit elements are selected such that the horn will sound when the electrical resistance of the chamber 12 is consistent with the presence therein of the predetermined level of combustion products. Through selection of the size of the intercepting means and the precise location of the target plate 86, the resistance of the chamber when the intercepting means is in its second position and there is no smoke in the chamber can be made the same as it is when the predetermined level of combustion products are present. In this manner, depression of the button will simulate the presence of the predetermined minimum level of combustion products in the chamber by increasing the resistance of the chamber and thereby causing the alarm circuitry to sound the alarm. Under these circumstances, the sounding of the alarm indicates that not only the alarm circuitry is operating properly, but also that the chamber will respond properly when the predetermined level of smoke is present. If the alarm should not sound, it is an indication that either the alarm circuitry or the chamber itself is not operating properly.

The precise size of the target plate 86 and the stud 88 and their locations within the chamber 12 may be determined by those skilled in the art. In one embodiment of the invention, smoke detector incorporating the test apparatus of this invention has been built and successfully operated, the detector including a measuring chamber 12 having a 1 microcurie source of Americium 241 and a reference chamber 14 having a 2 microcurie source of Americium 241. The chambers were adjusted to provide a saturation current of 35 pico-amperes ($35\times10^{-12}$ amperes) and a voltage of approximately 3.3 volts across the measuring chamber 12 in the absence of smoke when a battery having a voltage range of 12.5 to 10.5 volts is connected to the terminals 16 and 18. The spacing between the electrodes 20 and 22 was 0.767 centimeters to produce a voltage gradient of 5.9 volts per centimeter, and the spacing between the source 24 and the target plate 86 was 0.508 centimeters and 0.078 centimeters when the target plate 86 was in its first and second positions, respectively. The actual battery used was a Mallory Model No. 304116 having an initial voltage of 12.3 volts. The chambers 12 and 14 were further adjusted to provide a voltage of 4.3 volts, the threshold voltage of the MOSFET 34, when either the smoke level in the chamber reaches 2 percent smoke or the intercepting means is moved to its second position. The MOSFET 34 was a 3 N 163, and the resistors 36 and 38 had resistance values of 27,000 and 15,000 ohms, respectively. The SCR 40 was a C 103 B and the SCR 44 was a C 103 B. The resistances of the resistors 46 and 52 were 1,000 and 6,800 ohms, respectively. The horn 50 included a commercially available horn Model 16003196, available from Delta Electric of Marion, Indiana, in parallel with a 0.01 microfarad capacitor 60 and a 200 ohm resistor 58. The contacts 56 are in the enclosure of the horn. The capacitor 62 had a capacitance of 330 microfarads.

From the foregoing, it will be seen that this invention provides improved means for testing an ionization type smoke detector for proper operation, the test apparatus testing the entire system including the measuring chamber and the alarm apparatus. The test apparatus of this invention is capable of determining whether or not the smoke detector is operating properly when a predetermined level of smoke is present within the measuring chamber. For proper test operation, it is desirable that the intercepting means be electrically coupled to one of the chamber electrodes when it is in its first position and electrically isolated therefrom when moved from its first position.

While the invention has been particularly shown and described with reference to a preferred embodiment thereof, it will be understood by those skilled in the art that various changes in form, details, and application may be made therein without departing from the spirit and scope of the invention. Accordingly, it is intended that all such modifications and changes be included within the scope of the appended claims.

What is claimed as new and is desired to secure by Letters Patent of the United States is:

1. A smoke detector of the ionization type comprising:

a measuring chamber having an interior substantially freely accessible to airborne products of combustion, first and second spaced-apart electrodes within said measuring chamber, a source of alpha radiation for ionizing air between said first and second electrodes such that current flows between said electrodes when appropriate voltage is applied across said first and second electrodes, alarm means coupled to said measuring chamber for producing an alarm signal when the electrical resistance of said measuring chamber is consistent with the presence within said measuring chamber of a predetermined level of airborne products of combustion, and test apparatus comprising:

intercepting means within said measuring chamber movable between a first neutral position and a second position closer to said source of alpha radiation for intercepting alpha particles, said intercepting means being separate from said source of alpha radiation and being electrically insulated from each of said first and second electrodes at least when said intercepting means is in said second position, and manually operable means coupled to said intercepting means for moving said intercepting means between said first and second positions to increase the electrical resistance between said first and second electrodes, the size of said intercepting means and the location of said second position being such that the electrical resistance between said first and second electrodes when said intercepting means is in said second position is substantially identical to the electrical resistance between said first and second electrodes when said intercepting means is in said first position and said predetermined level of airborne products of combustion is present within said measuring chamber, whereby the presence within said measuring chamber of said predetermined level of airborne products of combustion may be simulated by moving said intercepting means to said second position so as to test the responsiveness of said alarm means.

2. A smoke detector as defined by claim 1 in which said manually operable means for moving said intercepting means comprises a button mounted externally of said measuring chamber and shaft means interconnecting said button and said intercepting means within said measuring chamber.

3. A smoke detector as defined by claim 1 in which said intercepting means is electrically coupled to a selected one of said first and second electrodes only when said intercepting means is in said first position, said intercepting means being electrically insulated from each of said first and second electrodes when said intercepting means is in said second position and substantially all positions intermediate said first and second positions.

4. A smoke detector as defined by claim 3 in which said manually operable means for moving said intercepting means comprises a button mounted externally of said measuring chamber, shaft means interconnecting said button and said intercepting means within said measuring chamber, and biasing means urging said intercepting means toward said first position.

5. A smoke detector as defined by claim 4 in which said intercepting means includes an electrically conductive member contacting said selected electrode when said intercepting means is in said first position and spaced from both of said first and second electrodes when said intercepting means is moved from said first position.

6. A smoke detector as defined by claim 5 in which said shaft means is an electrical insulator.

7. A smoke detector as defined by claim 6 in which only said electrically conductive member extends into said measuring chamber when said intercepting means is moved between said first and second position.

* * * * *